US006255764B1

(12) United States Patent
Choi et al.

(10) Patent No.: US 6,255,764 B1
(45) Date of Patent: Jul. 3, 2001

(54) ELECTRON GUN CATHODE WITH A METAL LAYER HAVING A RECESS

(75) Inventors: Jong-Seo Choi; Yoon-Chang Kim; Gyu-Nam Joo, all of Kyonggi-do (KR)

(73) Assignee: Samsung Display Devices Co., Ltd. (KR)

( * ) Notice: Subject to any disclaimer, the term of this patent is extended or adjusted under 35 U.S.C. 154(b) by 0 days.

(21) Appl. No.: 09/298,397

(22) Filed: Apr. 23, 1999

(30) Foreign Application Priority Data

Sep. 24, 1998 (KR) ..... 98-39598

(51) Int. Cl.[7] ..... H01J 19/06

(52) U.S. Cl. ..... 313/346 R; 313/346 DC; 313/270

(58) Field of Search ..... 313/346 R, 346 DC, 313/446, 451, 450, 270

(56) References Cited

U.S. PATENT DOCUMENTS 4,893,052 * 1/1990 Tanabe et al. ..... 313/346 R
5,698,937 * 12/1997 Ju et al. ..... 313/346 R
6,091,189 * 7/2000 Shinjo et al. ..... 313/346 R

* cited by examiner

*Primary Examiner*—Nimeshkumar D. Patel
*Assistant Examiner*—Joseph Williams
(74) *Attorney, Agent, or Firm*—Baker & McKenzie

(57) ABSTRACT

The present invention relates to a cathode for an electron gun for increasing its life cycle under a high current density load by ensuring a steady diffusion path of reducing component served for generating free radical barium. The present invention discloses a cathode for an electron gun comprising a base metal composed of nickel and at least one kind of reducing component, a metal layer having a recess to enlarge an overall surface area of the metal layer, the metal layer being disposed on the base metal, and an electron emitting layer containing alkaline earth metal oxide including at least barium. The cathode for an electron further comprises a second metal layer disposed on the lower side of the base metal.

18 Claims, 9 Drawing Sheets

ELECTRON GUN CATHODE WITH A METAL LAYER HAVING A RECESS

BACKGROUND OF THE INVENTION

1. Field of the Invention

The present invention relates to a cathode for an electron gun used in a cathode ray tube, and more particularly, to a cathode for an electron gun for increasing its life cycle under a high current density load by ensuring a steady diffusion path of reducing component served for generating free radical barium.

2. Description of the Prior Art

A cathode ray tube is a device for forming an image by excitation light emission of a fluorescent material of a screen by landing an electron emitted from an electron gun and accelerated by high voltage on the fluorescent material.

FIG. 8 is a general structural diagram of a cathode for an electron gun in a cathode ray tube.

In FIG. 8, the cathode comprises a heater 4 in a sleeve 2, a cap-formed base metal 6 composed of nickel Ni as a main component and a small amount of reducing component such as silicon Si and magnesium Mg on the upper side of sleeve 2, and an electron emitting layer 8 mainly composed of alkaline earth metal oxide containing at least barium on the cap-formed base metal 6.

In such a cathode, the metal oxide and the reducing component react to each other by heat from the heater to generate free radical barium, and thereafter thermion is emitted by using free radical barium.

An electron emission capacity of the cathode for the electron gun is depended on a supply amount of free radical barium contained in the metal oxide.

However, since the cathode ray tube has a tendency of high brightness and long-life cycle recently, a cathode which can supply free radical barium for a long time in high current density is required.

A cathode restraining free radical barium from evaporating by adding both of lanthanum La compound and magnesium compound Mg or La—Mg mixed compound to the electron emitting layer containing alkaline earth metal oxide is disclosed.

However, in the conventional cathode, an intermediate layer 10 is generated in a boundary between the base metal 6 and electron emitting layer 8 by reaction as shown in FIG. 9, and it results to shorten the life of the cathode under high current density load of 2~3 A/cm$^2$.

The intermediate layer 10 is generated by reaction of barium oxide pyrolized from barium carbonate and silicon or magnesium.

$$BaO+Mg \rightarrow Mg+Ba\uparrow \quad \text{[Reaction formula 1]}$$

$$4BaO+Si \rightarrow Ba_2SiO_4+2Ba\uparrow \quad \text{[Reaction formula 2]}$$

Free radical barium generated by the reaction formula 1 or 2 is served to emit electron. However, MgO or $Ba_2SiO_4$ is additionally generated by the same reaction formulas to generate the intermediate layer 10 in the boundary between the base metal 6 and the electron emitting layer 8.

Such an intermediate layer 10 interferes the reaction for generating free radical barium requiring the reducing component by obstructing diffusion of the reducing component contained in the base metal 6, to shorten the life of the cathode. In addition, since the intermediate layer 10 has a high resistance, it limits the current density possible to emit the electron by interfering flow of the electron emitting current.

In another aspect, a cathode for an electron gun comprising a metal layer mainly composed of tungsten of which the reducing degree is same as or smaller than silicon or magnesium and larger than nickel between the base metal and the electron emitting layer, and the electron emitting layer containing rare earth metal oxide to decompose the compound generated from the reaction, and thereby enabling the reducing component in the metal layer to serve to generate free radical barium is disclosed in Japanese patent laid-open No. 91-257735.

However, the cathode described above is stable at the beginning but its life cycle is suddenly deteriorated with the lapse of time since the additional reaction compound is generated when free radical barium is generated.

SUMMARY OF THE INVENTION

Accordingly, the present invention is directed to a cathode for an electron gun that substantially obviates one or more of the problems due to limitations and disadvantages of the related art.

An object of the present invention is to provide a cathode for an electron gun for increasing its life cycle under a high current density load by ensuring a steady diffusion path of reducing component of a base metal used for good generation of free radical barium.

Another object of the present invention is to provide a cathode for an electron gun for preventing the shortening of its life cycle due to the loss of reducing component by obstructing the backward diffusion of reducing component contained in the base metal.

To achieve the above objectives, the present invention provides a cathode for an electron gun comprising:

- a base metal composed of nickel and at least one kind of reducing component,
- a metal layer having a recess to enlarge an overall surface area of the metal layer, the metal layer being disposed on the base metal ; and
- an electron emitting layer containing alkaline earth metal oxide including at least barium on the metal layer.

The metal layer is formed by spreading a material selected from the group consisting of nickel, tungsten, nickel-zirconium, zirconium-tungsten and nickel-tungsten to have a recess in its center using a mask and heating it or by adhering a powder selected from the group consisting of nickel, tungsten, nickel-zirconium, zirconium-tungsten or nickel tungsten thereon to have a particle size smaller than that of the base metal.

According to another aspect, the present invention also provides a cathode for an electron gun further comprising a second metal layer made of at least one material selected from the group consisting of nickel, tungsten, tantalum and molybdenum on a lower side of the base metal. The same layer is formed by spreading or coating.

According to the present invention, since the metal layer has a particle size smaller than that of the base metal and particularly the diffusion area of reducing component is enlarged by a recess formed in the metal layer, the metal layer effectively disperses a reactant generated by the reaction of BaO and Si or Mg to prevent the generation of the intermediate layer having high resistance and to ensure a steady diffusion path of the reducing component.

In result, the reaction for generating free radical barium requiring the reducing component can be continued to increase life cycle of the cathode under high current density load of 2~3 A/cm$^2$.

Further, according to the present invention, since a second metal layer is formed on the lower side of the base metal to obstruct the backward diffusion and loss of reducing component, much more reducing component reacts to electron emitting material to increase life cycle of the cathode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the present invention and are incorporated in and constitute a part of this specification, illustrate embodiments of the present invention and together with the description serve to explain the principles of the present invention.

In the drawings.

DETAILED DESCRIPTION OF THE PREFERRED EMBODIMENTS

Figure 1:
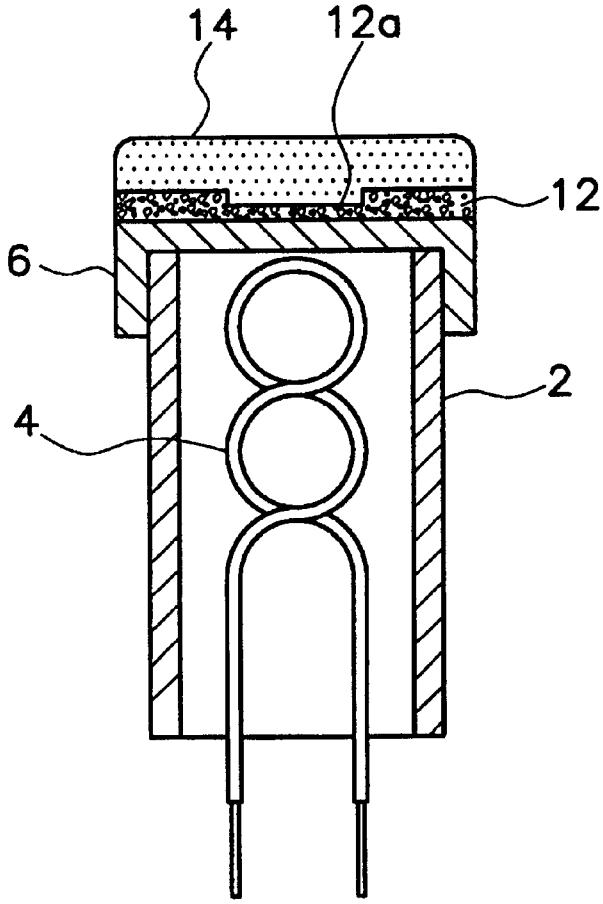
FIG. 1 is a sectional view of a cathode for an electron gun in accordance with a first embodiment of the present invention.

Reference will now be made in detail to the preferred embodiments of the present invention, examples of which are illustrated in the accompanying drawings. Like reference numerals denote like reference parts throughout the specification and drawings.

EMBODIMENT 1

As shown in FIG. 1, a cathode for an electron gun according to a first embodiment of the present invention comprises a cap-formed base metal 6 composed of Ni and a small amount of reducing component such as Si or Mg, the base metal being disposed on upper opening portion of a sleeve 2 in which a heater 4 is mounted.

The cathode for the electron gun further comprises a metal layer 12 containing a material selected from the group consisting of pure Ni, W, Ni—Zr, Zr—W and Ni—W on the upper side of the base metal 6, and an electron emitting layer 14 composed of alkaline earth metal oxide such as ternary carbonate $(Ba.Sr.Ca)CO_3$ or binary carbonate $(Ba.Sr)CO_3$ containing at least Ba on the upper side of the metal layer.

In the present embodiment, to disperse the material generated from the reaction of BaO and Si or Mg and accumulated in the boundary between the base metal 6 and the electron emitting layer 14, a metal layer 12 composed of a fine-grained material selected from the group consisting of pure Ni, W, Ni—Zr, Zr—W and Ni—W is formed, and to smoothly diffuse reducing component, a recess 12*a* is formed in the metal layer 12 to enlarge an overall surface area.

Figure 2:
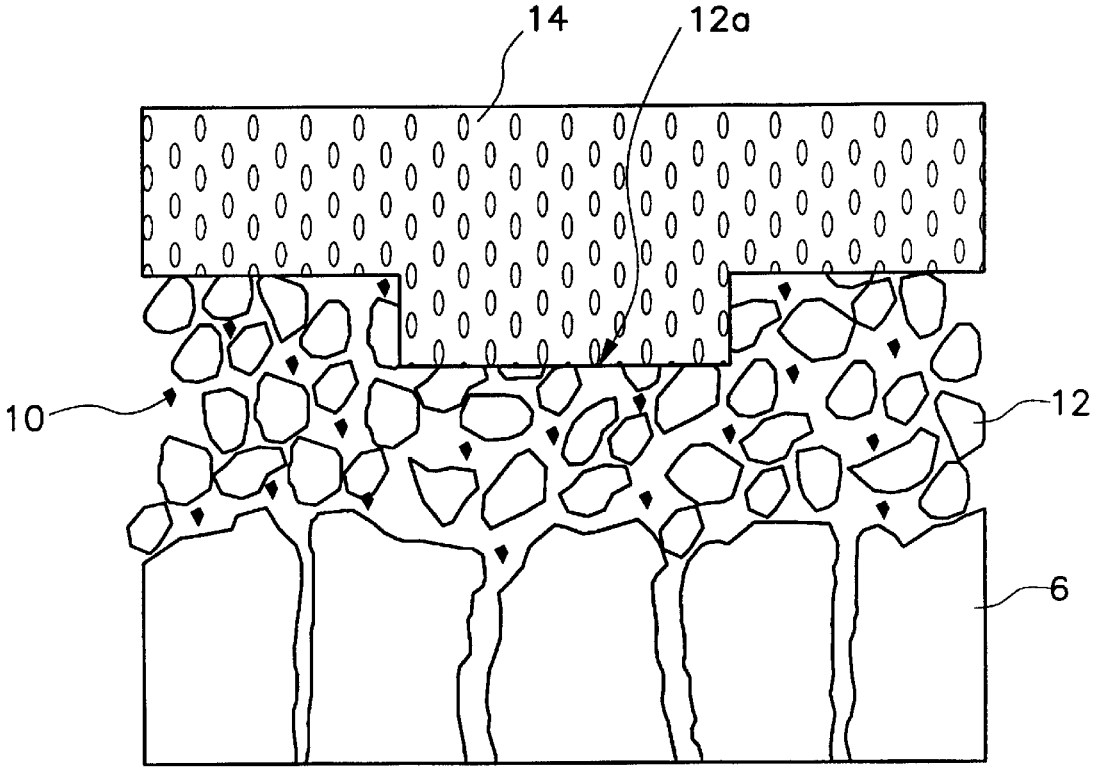
FIG. 2 is an enlarged sectional view of a main part of a cathode for an electron gun in accordance with the first embodiment of the present invention.

Since the metal layer 12 according to the present embodiment is formed of particles smaller than those of the base metal 6 as shown in FIG. 2, the diffusion path of the reducing component contained in the base metal 6 is dispersed, and therefore, the reaction of BaO and Si or Mg is performed in many area of the metal layer 12, the intermediate layer 10 is restrained from being accumulated, and the reducing component such as Si and Mg is smoothly diffused to be served to generate free radical barium.

Since the recess 12*a* formed in the metal layer 12 enlarges the surface area of the boundary, the reducing component is smoothly diffused though the intermediate layer 10 is generated.

The metal layer 12 is formed by cleaning a base metal 6, firstly forming a layer containing a material selected from the group consisting of Ni, W, Ni—Zr, Zr—W and Ni—W on an upper side of the base metal 6 by RF sputtering, secondly forming the layer to a thickness of 500~50,000 Å by using a mask in the form of recess 12*a*, and heating it in the temperature of 650~1,100° C. in an reduction or vacuum condition to perform an alloying and diffusion between the base metal 6 and the metal layer 12.

The thickness of the metal layer 12 is preferable 500~50,000 Å.

It is difficult to ensure the diffusion path of the reducing component when the thickness is less than 500 Å and when the thickness is more than 50,000 Å, the diffusion of the reducing component is interfered.

Preferably, the optimum thickness of the metal layer 12 of the present embodiment is 8,000~30,000 Å.

The metal layer 12 is also formed by adhering a powder selected from the group consisting of Ni, W, Ni—Zr, Zr—W and Ni—W on the upper side of the base metal 6.

At this point, the adhesion is realized by physical, chemical, or mechanical methods such as spray, print, electrodeposition, or metallic salt dissolution.

The electron emitting layer 14 of ternary carbonate or binary carbonate is formed on the upper side of the metal layer 12 to the thickness of 20~100 $\mu$m by spray. At this point, the thickness of the entire cathode must not exceed 300 $\mu$m.

Further, according to the present embodiment, the electron emitting layer 14 may be formed on the upper side of the metal layer 12 by adding both of La compound and Mg compound or La—Mg mixed compound in alkaline earth metal oxide such as ternary carbonate $(Ba.Sr\ .Ca)CO_3$ or binary carbonate $(Ba.Sr)CO_3$ containing at least Ba.

The La compound and Mg compound or La—Mg mixed compound restrains evaporation of free radical Ba to be continuously supplied. The content of the La compound and Mg compound or La—Mg mixed compound is preferably 0.01~1 wt % of the carbonate.

When the content thereof is less than 0.01 wt %, the evaporation of free radical Ba can not be effectively restrained and when the content thereof is more than 1 wt %, the electron emitting capacity at the beginning can be deteriorated.

According to the present embodiment, the intermediate layer 10 is effectively dispersed by the metal layer 12 and the evaporation of free radical Ba generated from the reaction of BaO and Si or Mg is restrained by the electron emitting layer 14.

Figure 3:
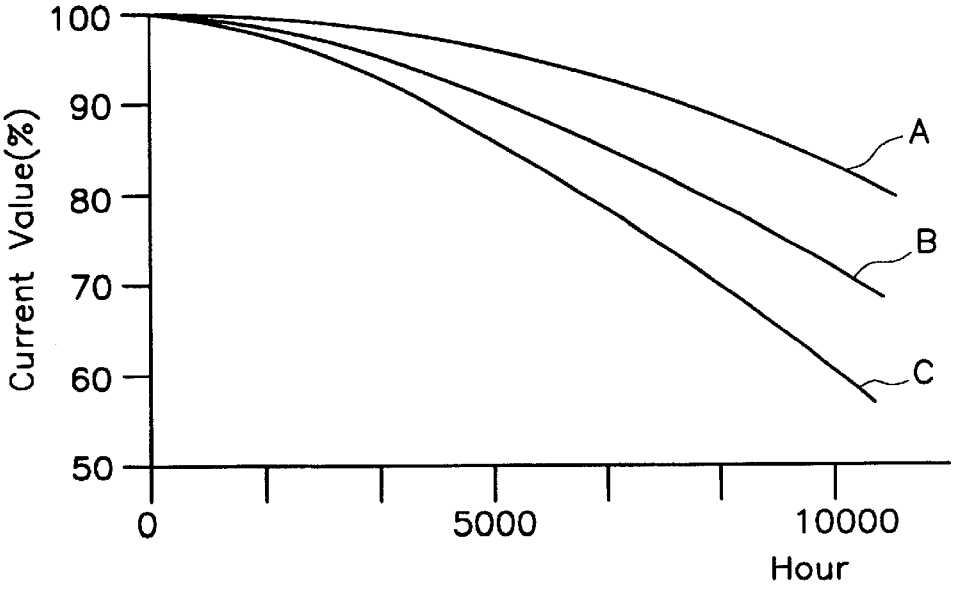
FIG. 3 is a diagram showing a life cycle characteristic of a cathode for an electron gun in accordance with the first embodiment of the present invention.

FIG. 3 shows a result of testing a life cycle characteristic of the cathode for the electron gun according to the present embodiment.

In FIG. 3, the graph A shows the life cycle of the cathode comprising the electron emitting layer 14 which is made of carbonate containing 0.5 wt % of La—Mg compound and the metal layer 12 having thickness of 500~50,000 Å according to the first embodiment of the present invention.

The graph B shows the life cycle of a conventional oxide cathode comprising an electron emitting layer made of carbonate containing 0.5 wt % of La—Mg compound, and the graph C shows the life cycle of the conventional oxide cathode comprising an electron emitting layer made of only carbonate.

The test of life cycle is performed by measuring the decreasing amount of the electron emitting current while continuously operating for 10,000 hours. At this moment, 2,000~3,000 $\mu$A of current is applied to each cathode.

As shown in FIG. 3, the cathode for the electron gun according to the present embodiment is considerably improved in its life cycle in high current in comparison with B or C according to the conventional art.

Using the cathode according to the present invention, 85% of first current value is maintained after operating for 10,000 hours in high current density.

EMBODIMENT 2

Figure 4:
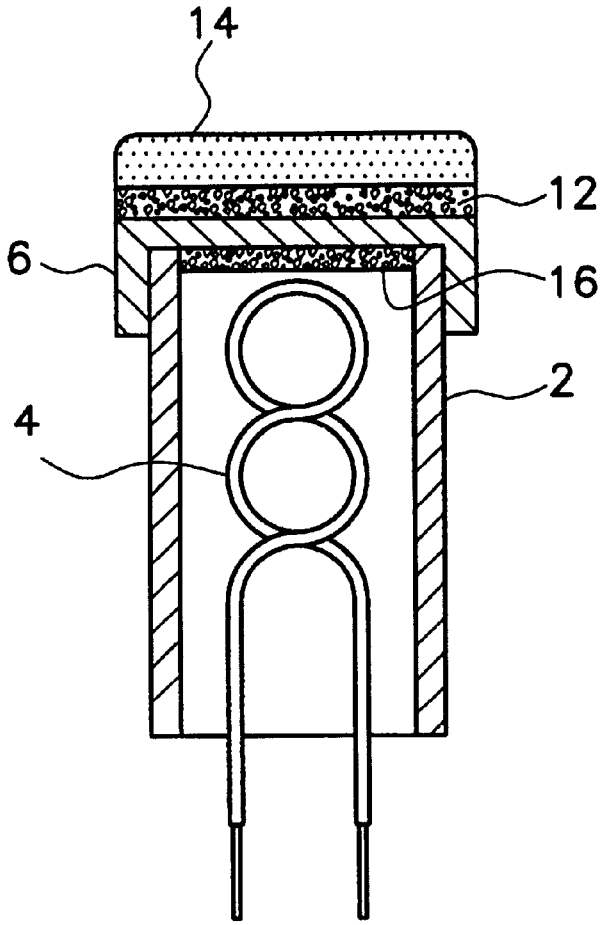
FIG. 4 is a sectional view of a cathode for an electron gun in accordance with a second embodiment of the present invention.

FIG. 4 shows a cathode for an electron gun in accordance with a second embodiment of the present invention.

As shown in FIG. 4, a cathode for an electron gun according to a second embodiment of the present invention comprises a base metal 6, a metal layer 12 composed of a material selected from the group consisting of pure Ni, W, Ni—Zr, Zr—W or Ni—W on the upper side of the base metal 6, and an electron emitting layer 14 composed of ternary carbonate or binary carbonate containing at least Ba on the upper side of the metal layer 12. The electron emitting layer 14 may further contains both of La compound and Mg compound or La—Mg mixed compound.

According to the present embodiment, the cathode for electron gun further comprises a second metal layer 16 disposed on the lower side of the base metal 6.

The second metal layer 16 obstructs the diffusion toward the back of the base metal 6 or loss of the reducing component, and thereby much more reducing component reacting to the electron emitting material.

The second metal layer 16 may be composed of a metal having high melting point such as Ni, W, Mo or Ta.

The metal layer 12 and the second metal layer 16 are obtained by cleaning a base metal 6, forming layers having thickness of 500~50,000 Å on an upper side and an lower side of the base metal 6 respectively by RF sputtering, and heating it in the temperature of 650~1,100° C. in an reduction or vacuum condition to perform an alloying and diffusion between the base metal 6, the metal layer 12, and the second metal layer 16.

In addition, the metal layer 12 and the second metal layer 16 may be formed on the upper side and the lower side of the base metal 6 respectively to a thickness of 500~50,000 Å by electroplating or non-electrolysis coating.

The metal layer 12 and the second metal layer 16 may be formed by physical, chemical, or mechanical methods such as spray, print, electrodeposition, or metallic salt dissolution.

The electron emitting layer 14 of ternary carbonate or binary carbonate is formed on the upper side of the metal layer 12 to a thickness of 20~100 $\mu$m by coating.

Further, the electron emitting layer 14 may be formed on the upper side of the metal layer 12 by coating alkaline earth metal oxide such as ternary carbonate or binary carbonate which is added both of La compound and Mg compound or La—Mg mixed compound.

At this point, the thickness of the entire cathode must not exceed 300 $\mu$m.

Figure 5:
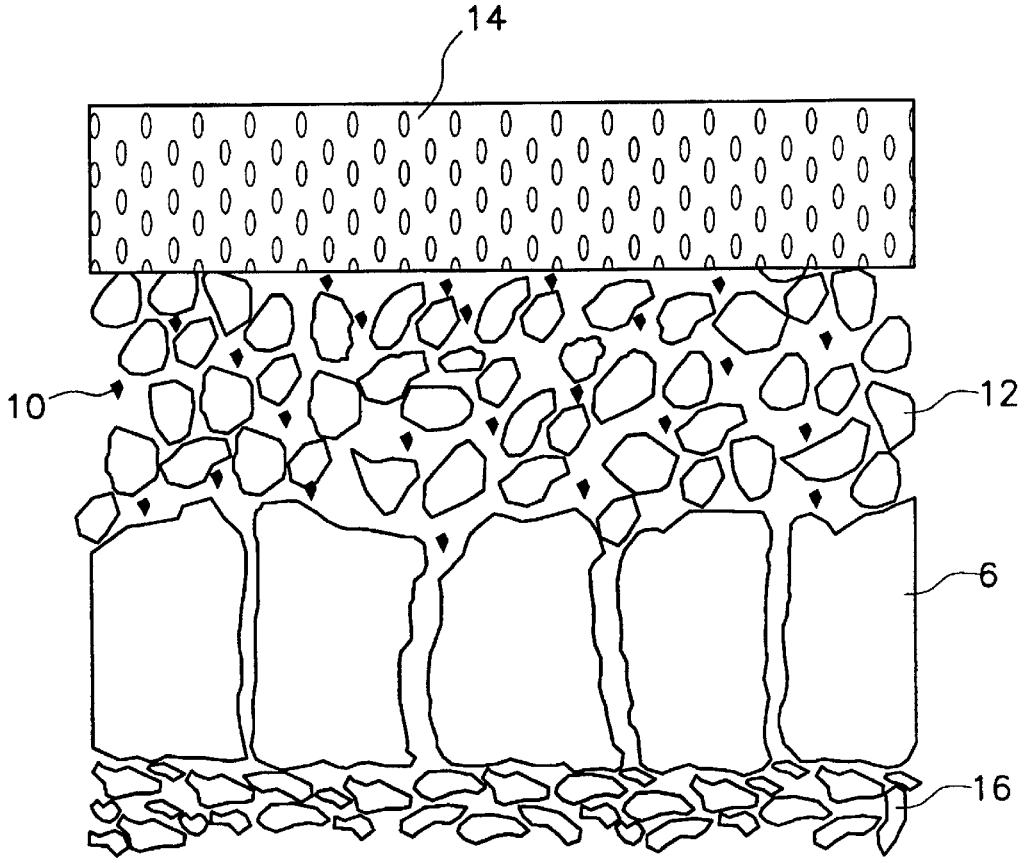
FIG. 5 is an enlarged sectional view of a main part of a cathode for an electron gun in accordance with the second embodiment of the present invention.

Since the metal layer 12 according to the present embodiment is formed of particles smaller than those of the base metal 6 as shown in FIG. 5, the diffusion path of the reducing component contained in the base metal 6 is dispersed, and therefore, the reaction of BaO and Si or Mg is performed in many area of the metal layer 12, the intermediate layer 10 is restrained from being accumulated, and the reducing component such as Si and Mg is smoothly diffused to be served to generate free radical barium.

Further, according to the present embodiment, since the backward diffusion of reducing component is obstructed by a second metal layer 14 to prevent the loss of reducing component, the reducing component for the generation of free radical barium can be supplied to increase life cycle of the cathode.

Figure 6:
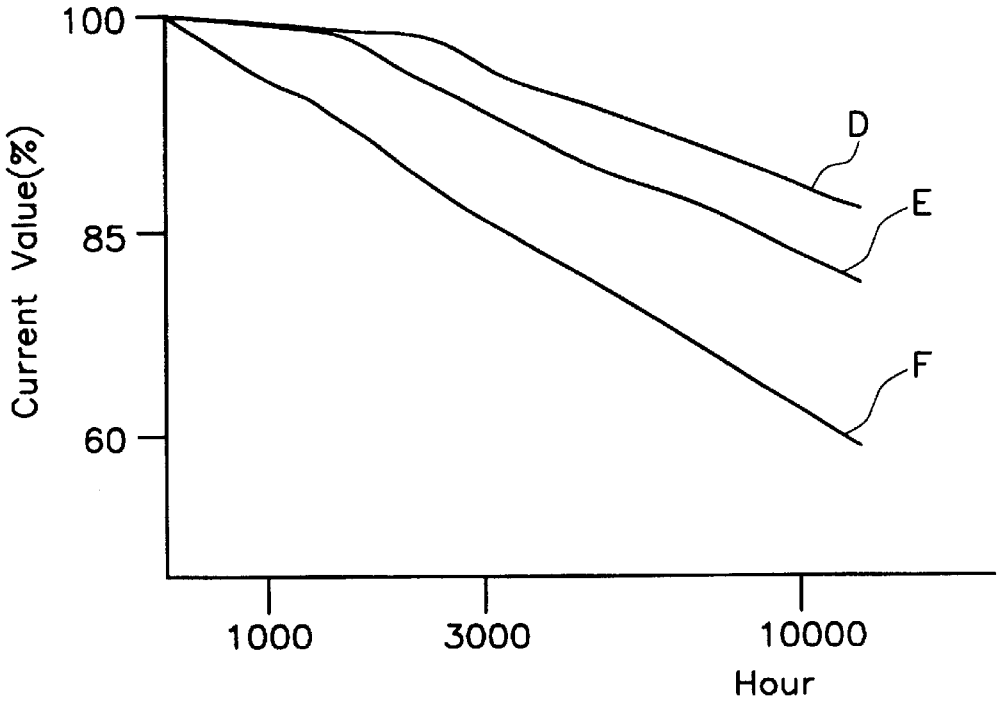
FIG. 6 is a diagram showing a life cycle characteristic of a cathode for an electron gun in accordance with the second embodiment of the present invention.

FIG. 6 shows a result of testing the life cycle characteristic of the cathode for the electron gun according to the present embodiment.

In FIG. 6, the graph D shows the life cycle of the cathode according to the present embodiment comprising the electron emitting layer 14 which is made of carbonate containing 0.5 wt % of La—Mg compound, the metal layer 12 and the second metal layer 16, each having thickness of 500 50,000 Å.

The graph E shows the life cycle the conventional oxide cathode comprising carbonate containing 0.5 wt % of La—Mg compound, and the graph F shows the life cycle of the conventional oxide cathode using carbonate only.

The test of life cycle is performed by measuring the decreasing amount of the electron emitting current while continuously operating for 10,000 hours.

At this moment, 2,000~3,000 $\mu$A of current is applied to each cathode.

As shown in FIG. 6, the cathode for the electron gun according to the present embodiment is considerably improved in its life cycle in high current in comparison with B or C according to the conventional art.

Using the cathode according to the present invention, 85% of first current value is maintained after operating for 10,000 hours in high current density.

EMBODIMENT 3

Figure 7:
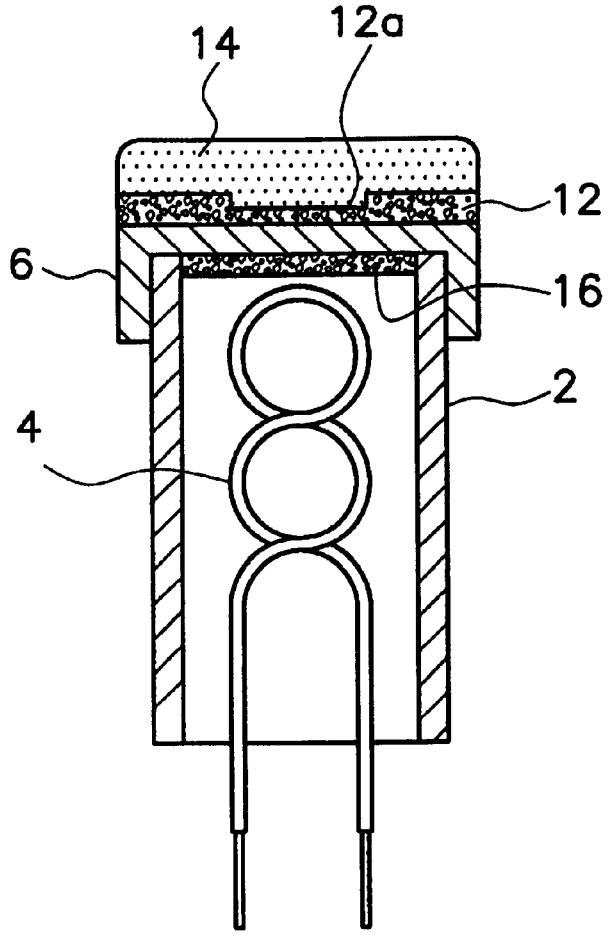
FIG. 7 is a sectional view of a cathode for an electron gun in accordance with a third embodiment of the present invention.
Figure 8:
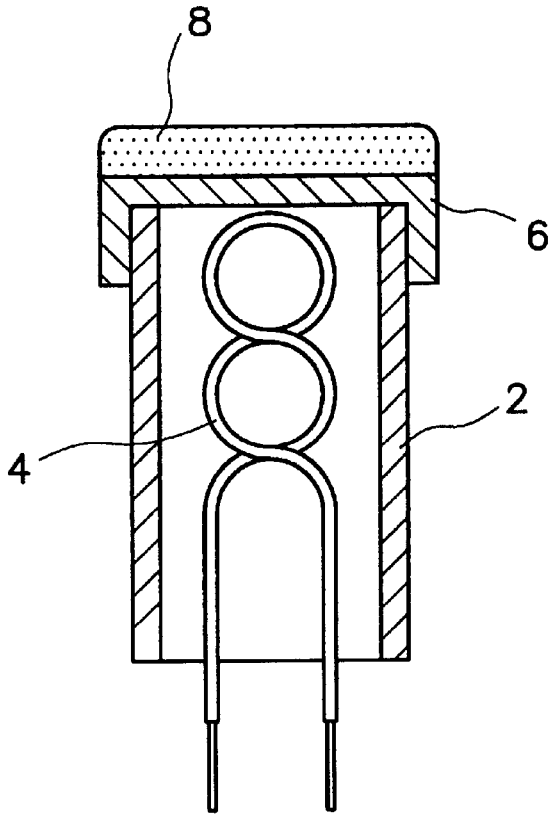
FIG. 8 is a sectional view of a conventional cathode for an electron gun.
Figure 9:
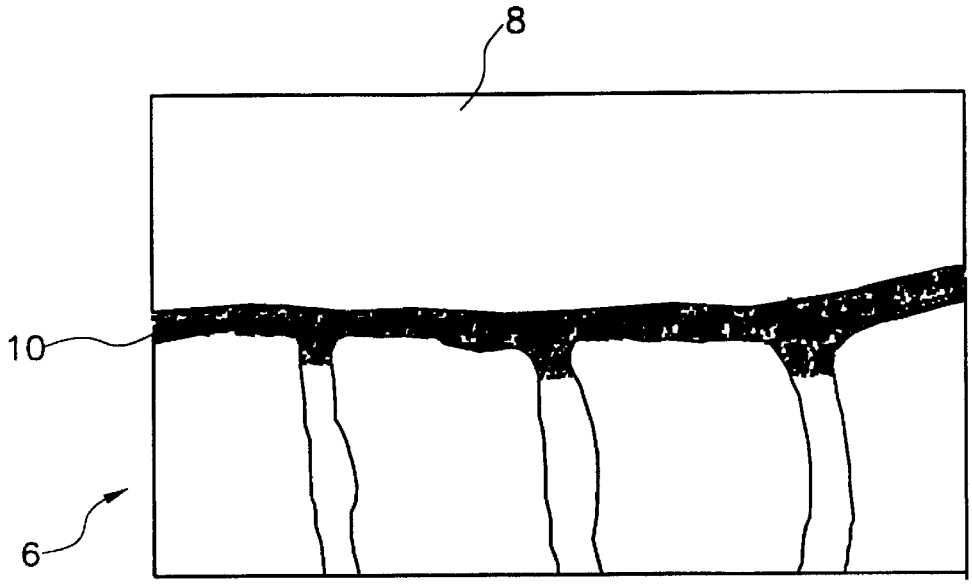
FIG. 9 is an enlarged sectional view of a conventional cathode.

FIG. 7 shows a cathode for electron gun having characteristics of the first and the second embodiments.

As shown in FIG. 7, a cathode for an electron gun according to the present embodiment comprises a base metal 6, a metal layer 12 composed of a material selected from the group consisting of pure Ni or W, or Ni—Zr, Zr—W or Ni—W and having a recess 12*a* in the center, and an electron emitting layer 14 composed of ternary carbonate or binary carbonate containing at least Ba on the upper side of the metal layer 12. The electron emitting layer 14 may further contains both of La compound and Mg compound or La—Mg mixed compound.

The cathode for an electron gun according to the present embodiment further comprises a second metal layer 16 mainly composed of one selected from the group consisting of Ni, W, Mo or Ta on the lower part of the base metal 6 to prevent the backward diffusion and the loss of the reducing component.

The metal layer 12 and the second metal layer 16 according to the present embodiment is formed to a thickness of 500 ~50,000 Å by spreading and adhering as described in the first and the second embodiments.

Since the metal layer 12 according to the present embodiment is formed of particles smaller than those of the base metal 6, the diffusion path of the reducing component contained in the base metal 6 is dispersed, and therefore, the reaction of BaO and Si or Mg is performed in many area of the metal layer 12, the intermediate layer 10 is restrained from being accumulated, and the reducing component such as Si and Mg is smoothly diffused to be served to generate free radical barium.

Further, since the recess 12*a* formed in the metal layer 12 enlarges the overall surface area of the boundary, the reducing component is smoothly diffused though the intermediate layer 10 is generated.

Further, since the backward diffusion of reducing component is obstructed by a second metal layer 14 to prevent the loss of reducing component, the reducing component for the generation of free radical barium can be supplied to increase life cycle of the cathode.

According to the present embodiment, the cathode for the electron gun is improved in its life cycle at 5~10% in comparison with the first or the second embodiment in the test that 2,000~3,000 $\mu$A of current is applied to each cathode.

According to the present invention, since the metal layer having fine grain disperses the intermediate layer to ensure the steady diffusion path of the reducing component, free radical Ba can be continuously emitted.

In particular, the metal layer comprises the recess to enlarge the diffusion area of the reducing component, therefore, free radical Ba can be continuously emitted though the intermediate layer is generated.

In addition, since the inventive cathode comprises the electron emitting layer containing both of La compound and Mg compound or La—Mg mixed compound, the evaporation of free radical Ba can be restrained.

Further, since the inventive cathode comprises the second electron emitting layer on the lower side of the base metal to prevent the backward diffusion and the loss of the reducing component, free radical Ba can be continuously generated.

As described above, since free radical Ba is continuously emitted and restrained to be evaporated due to the interaction of the metal layer and the electron emitting layer or the second metal layer, the life cycle is improved even under high current density load of 2–3 A/cm$^2$.

In addition, the inventive cathode can be manufactured easily and at low price in comparison with the conventional impregnation cathode.

It will be apparent to those skilled in the art that various modifications and variations can be made in the cathode for the electron gun of the present invention without departing from the spirit or scope of the invention.

Thus, it is intended that the present invention cover the modifications and variations of this invention provided they come within the scope of the appended claims and their equivalents.

What is claimed is:

1. A cathode for an electron gun comprising:

a base metal composed of nickel and at least one kind of reducing component;

an electron emitting layer containing alkaline earth metal oxide including at least barium; and a metal layer having a recess to enlarge an overall surface area of the metal layer, the metal layer being disposed on the base metal between the base metal and the electron emitting layer, a portion of the electron emitting layer extending beyond the recess and on a non-recessed part of the metal layer.

2. The cathode for an electron gun according to claim 1 wherein the metal layer is composed of a material selected from the group consisting of nickel, tungsten, nickel-zirconium, zirconium-tungsten or nickel-tungsten.

3. The cathode for an electron gun according to claim 1 wherein the electron emitting layer further contains both of lanthanum compound and magnesium compound or lanthanum-magnesium mixed compound.

4. The cathode for an electron gun according to claim 3 wherein the metal layer is composed of a material selected from the group consisting of nickel, tungsten, nickel-zirconium, zirconium-tungsten or nickel-tungsten.

5. The cathode for an electron gun according to claim 1 wherein the metal layer is formed by first spreading a material selected from the group consisting of nickel, tungsten, nickel-zirconium, zirconium-tungsten or nickel-tungsten on an upper side of the base metal, second spreading using a mask in the form of recess, and heating it.

6. The cathode for an electron gun according to claim 1 wherein the metal layer is formed by first adhering a powder selected from the group consisting of nickel, tungsten, nickel-zirconium, zirconium-tungsten or nickel-tungsten on an upper side of the base metal, and second adhering using a mask in the form of recess.

7. The cathode for an electron gun according to claim 1 wherein the metal layer is formed of particles smaller than those of the base metal.

8. The cathode for an electron gun according to claim 1 wherein the metal layer has thickness of 500~50,000 Å.

9. A cathode for an electron gun comprising:

a base metal composed of nickel and at least one kind of reducing component;

an electron emitting layer containing alkaline earth metal oxide including at least barium;

a metal layer having a recess to enlarge the overall surface area of the metal layer, the metal layer being disposed on the upper side of the base metal between the base metal and the electron emitting layer, a portion of the electron emitting layer extending beyond the recess and on a non-recessed part of the metal layer; and a second metal layer disposed on the lower side of the base metal.

10. The cathode for an electron gun according to claim 9 wherein the metal layer is composed of a material selected from the group consisting of nickel, tungsten, nickel-zirconium, zirconium-tungsten or nickel-tungsten.

11. The cathode for an electron gun according to claim 9 wherein the electron emitting layer further contains both of lanthanum compound and magnesium compound or lanthanum-magnesium mixed compound.

12. The cathode for an electron gun according to claim 9 wherein the second metal layer is made of at least one material selected from the group consisting of nickel, tungsten, tantalum and molybdenum.

13. The cathode for an electron gun according to claim 9 wherein the metal layer and the second metal layer are formed by spreading nickel on the upper and the lower sides of the base metal and heating it.

14. The cathode for an electron gun according to claim 9 wherein the metal layer and the second metal layer are formed by adhesion nickel powder on the upper and the lower sides of the base metal.

15. The cathode for an electron gun according to claim 9 wherein the metal layer has thickness of 500~50,000 Å.

16. The cathode for an electron gun according to claim 9 wherein the second metal layer has thickness of 500~50,000 Å.

17. The cathode for an electron gun according to claim 9 wherein the metal layer is formed of particles smaller than those of the base metal.

18. The cathode for an electron gun according to claim 17 wherein the second metal layer is formed of particles smaller than those of the base metal.

* * * * *